US005127755A

United States Patent [19]

Bee

[11] Patent Number: 5,127,755

[45] Date of Patent: Jul. 7, 1992

[54] BINDER WITH SECURITY LOCK FEATURE

[75] Inventor: William E. Bee, Aldrich, Mo.

[73] Assignee: Olivetti Office USA Inc., Somerville, N.J.

[21] Appl. No.: 625,202

[22] Filed: Dec. 10, 1990

[51] Int. Cl.[5] ..... B42F 3/02; B42F 13/30; B42F 13/14

[52] U.S. Cl. ..... 402/2; 402/45; 402/48; 402/80 P

[58] Field of Search ..... 402/2, 45, 48, 80 P

[56] References Cited

U.S. PATENT DOCUMENTS

| | | | |
|---|---|---|---|
| 835,171 | 11/1906 | Walker | 402/45 |
| 986,609 | 3/1911 | Wagniere | 402/45 |
| 1,197,995 | 9/1916 | Alstrand | 402/45 |
| 1,922,691 | 8/1933 | Morehouse | 402/45 |
| 2,021,738 | 11/1935 | McClure | 402/45 |
| 2,668,541 | 2/1954 | Anglin | 402/45 |
| 2,791,220 | 5/1957 | McBee | 402/44 |
| 2,915,068 | 12/1959 | Miyamoto | 402/45 |
| 3,784,232 | 7/1974 | Greene | 402/2 X |
| 3,879,142 | 4/1975 | Takimoto | 402/25 |
| 4,693,625 | 9/1987 | Ohminato | 402/48 X |
| 4,730,950 | 3/1988 | Ohminato | 402/48 |
| 4,930,927 | 6/1990 | Dumas | 402/48 X |

*Primary Examiner*—Paul A. Bell

*Attorney, Agent, or Firm*—Senniger, Powers, Leavitt & Roedel

[57] ABSTRACT

A binder with a security lock feature having front and back cover panels connected by a spine, and a page-holding mechanism attached to the spine on the inside of the binder for releasably holding pages in the binder. The page-holding mechanism includes a post assembly having a plurality of posts extending generally transversely of the spine at locations spaced longitudinally of the spine for holding pages in the binder. Each post is made up of a pair of interengageable post elements separable to permit pages to be inserted into and removed from the binder. The post assembly is movable between a first position in which the post elements of each post are interengaged and inseparable, and a second position in which the post elements are separable. A latching member is movable between a latching position for latching the post assembly in the first position and a release position for enabling the post assembly to be moved to the second position. A security lock prevents the latching member from being moved from its latching position to its release position so as to lock the post assembly in its first position and thus secure the binder against removal of pages from the binder or insertion of pages into the binder.

6 Claims, 4 Drawing Sheets

BINDER WITH SECURITY LOCK FEATURE

BACKGROUND OF THE INVENTION

This invention relates generally to binders and, more particularly, to a binder with a security lock feature.

For various reasons, it is sometimes desirable to prevent unauthorized insertion of papers into a binder or unauthorized removal of pages from the binder. This cannot be done with binders of conventional design. There is a need, therefore, for a binder which may be readily secured against such unauthorized tampering.

SUMMARY OF THE INVENTION

Among the several objects of this invention may be noted the provision of a binder with a security lock feature which inhibits any unauthorized removal of pages from the binder or any unauthorized insertion of pages into the binder; the provision of such a binder which is easy to lock and unlock; and the provision of such a binder which, when unlocked, permits ready insertion of pages into the binder and/or removal of pages from the binder.

Generally, a binder with a security lock feature of the present invention comprises front and back cover panels connected by a spine, and a page-holding mechanism attached to the spine on the inside of the binder for releasably holding pages in the binder. The page-holding mechanism comprises a post assembly including a plurality of posts extending generally transversely of the spine at locations spaced longitudinally of the spine for holding pages in the binder. Each post comprises a pair of interengageable post elements separable to permit pages to be inserted into and removed from the binder. The post assembly is movable between a first position in which the post elements of each post are interengaged and inseparable, and a second position in which the post elements are separable. A latching member is movable between a latching position for latching said post assembly in said first position and a release position for enabling the post assembly to be moved to said second position. To lock the post assembly in its first position, and thus secure the binder against removal or insertion of pages, security lock means is provided.

These and other objects and features of this invention will be in part apparent and in part pointed out hereinafter.

BRIEF DESCRIPTION OF THE DRAWINGS

Corresponding parts are identified by corresponding reference numerals throughout the several views of the drawings.

DETAILED DESCRIPTION OF THE PREFERRED EMBODIMENT

Figure 1:
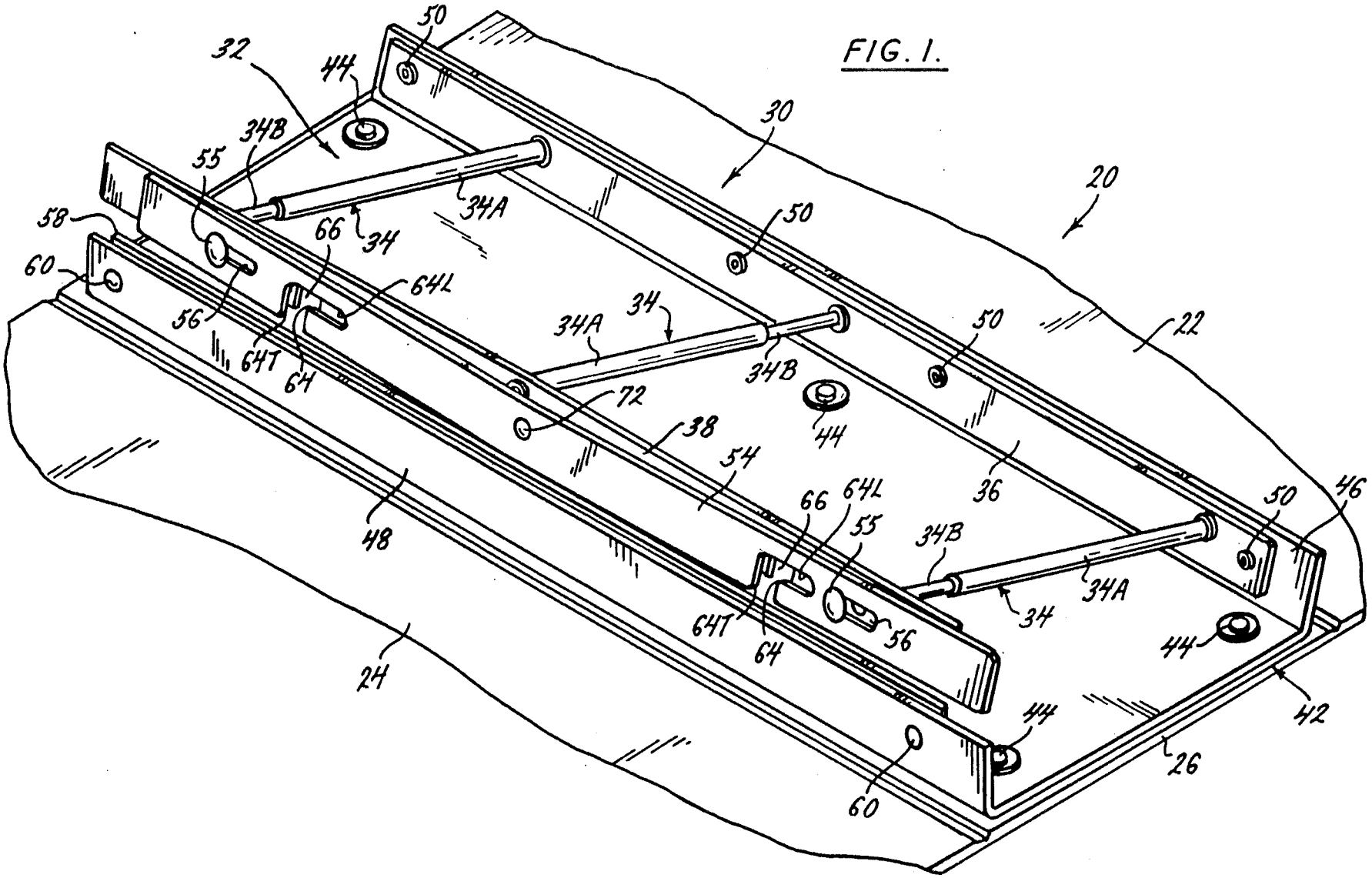
FIG. 1 is a fragmentary perspective of a binder of the present invention, showing its page-holding mechanism.
Figure 12:
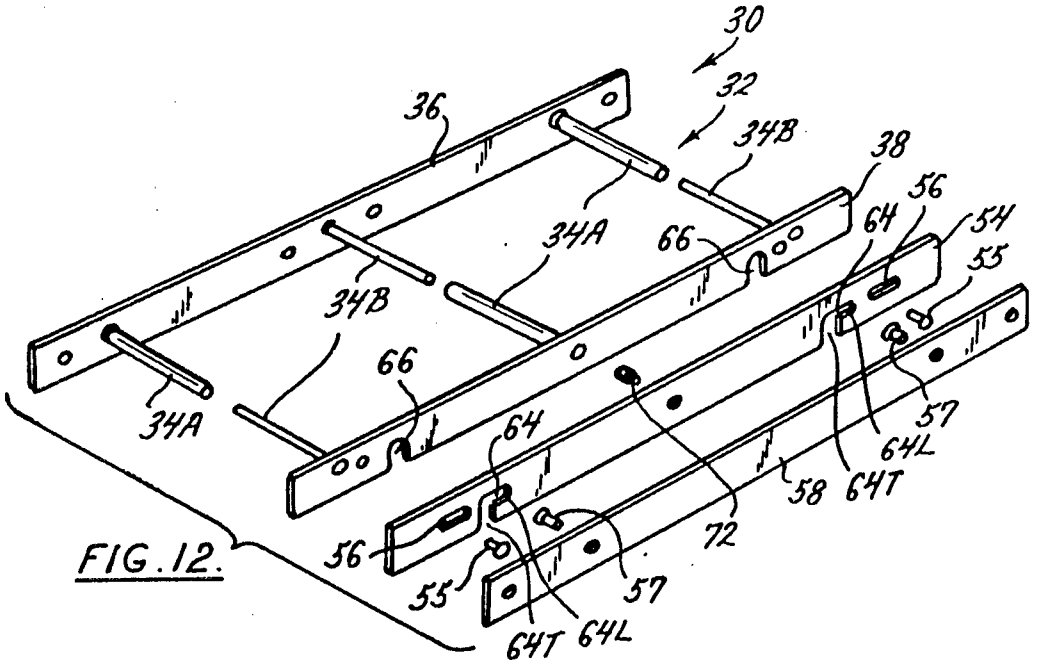
FIG. 12 is an exploded perspective showing the assembly of the page-holding mechanism.

Referring now to the drawings, and in particular to FIG. 1, a binder of the present invention, indicated generally at 20, is shown to comprise a front panel 22 and back panel 24 (fragments of which are shown) connected by a spine 26. A metal page-holding mechanism, indicated generally at 30, for releasably holding pages in the binder is attached to the spine 26 on the inside of the binder 20. An exploded view of the page-holding mechanism 30 is shown in FIG. 12 to illustrate its component parts. The page-holding mechanism 30 includes a post assembly, indicated generally at 32, having three posts 34 extending transversely of the spine 26 at locations spaced longitudinally of the spine. Each of the posts 34 comprises a pair of interengageable post elements including a first post element shown as a tube 34A which telescopically receives a second post element shown as a pin 34B therein. The post elements 34A, 34B may be separated to insert pages into and remove pages from the binder 20. The post assembly 32 further includes a first carrier strip 36 which extends lengthwise of the spine 26 generally adjacent one side of the spine and which carries one of the post elements (34A or 34B) of each post 34, and a second carrier strip 38 which extends generally parallel to the first carrier strip adjacent the opposite side of the spine and which carries the other post element (34B or 34A) of each post. When the post elements 34A, 34B are interengaged, the posts 34 thus formed extend between the carrier strips 36, 38.

Figure 3:
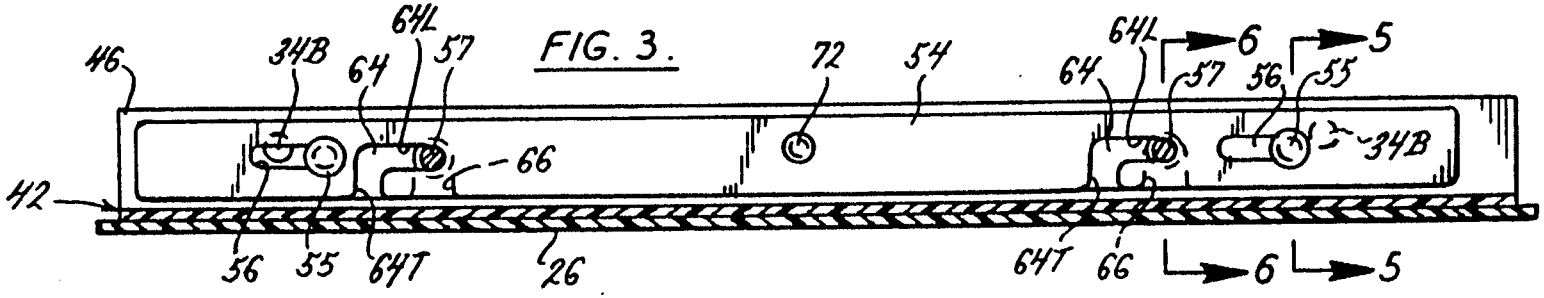
FIG. 3 is a section taken in the plane including line 3—3 of FIG. 2 showing the page-holding mechanism latching assembly in its locked latching position.
Figures 4, 5, 6, 7, 8, 9:
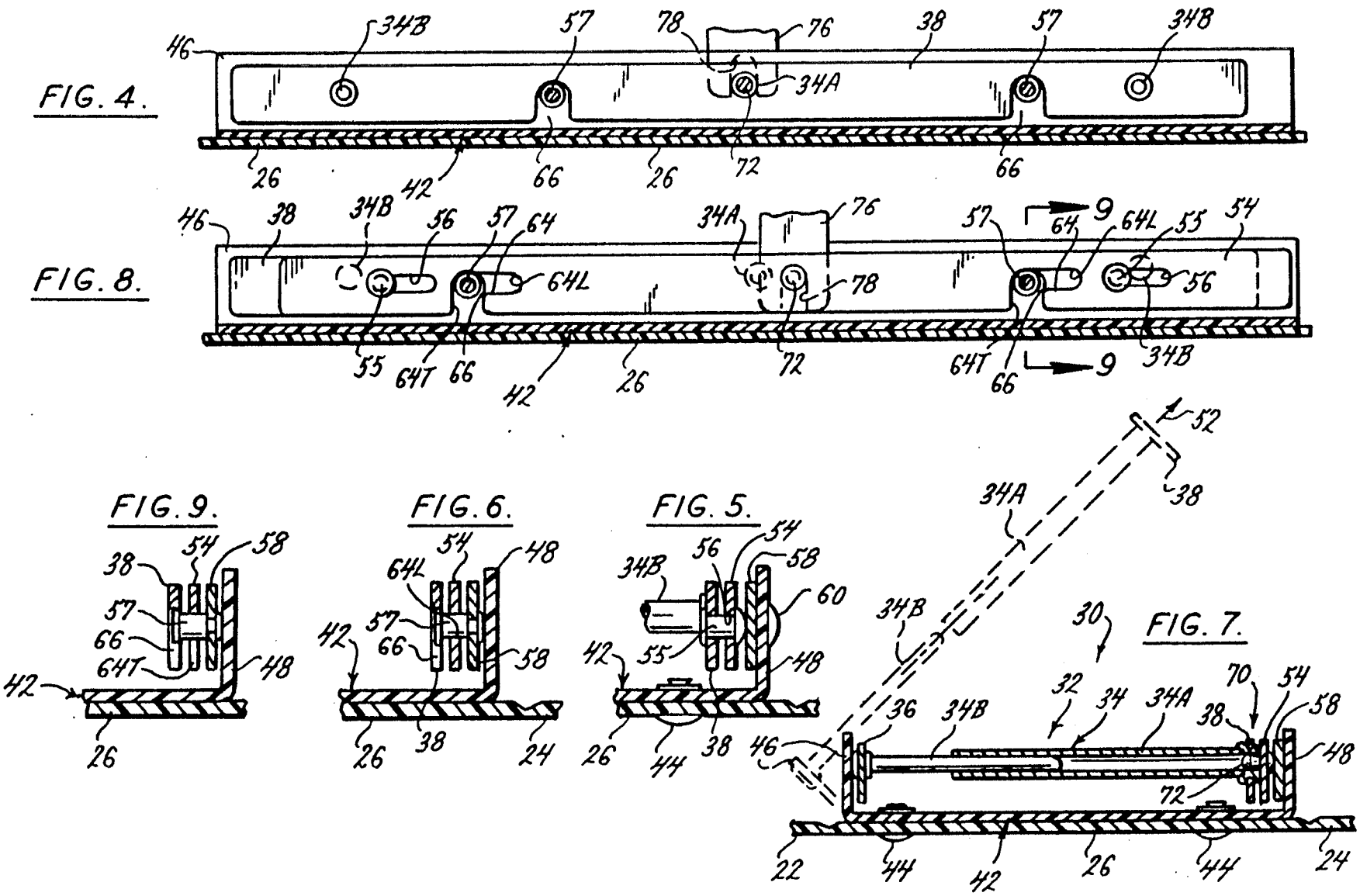
FIG. 4 is a section taken in the plane including line 4—4 of FIG. 2.
FIG. 5 is a section taken in the plane including line 5—5 of FIG. 3.
FIG. 6 is a section taken in the plane including line 6—6 of FIG. 3.
FIG. 7 is a section taken in the plane including line 7—7 of FIG. 2, the second position of the page-holding mechanism post assembly being shown in phantom.
FIG. 8 is a section similar to that shown in FIG. 4, but illustrating the latching member in its release position.
FIG. 9 is a section taken in the plane including line 9—9 of FIG. 8.

A support plate, indicated generally at 42, is affixed to the spine 26 by fasteners 44 and has opposite side margins bent to form a first flap 46 and second flap 48 extending lengthwise of the spine. The support plate 42 is made of a plastic material as shown in cross-section in FIGS. 3-10. Each flap is swingable relative to the spine 26 about an axis AX extending lengthwise of the spine. The first carrier strip 36 is fastened to the first flap 46 by suitable fasteners 50 and, as illustrated in FIG. 7, can be pivoted with the first flap on axis AX for moving the post assembly 32 between a first (lowered) position in which the post elements 34A, 34B are interengaged and inseparable, and a second (raised) position (shown in phantom) in which the post elements are separable by being pulled apart as indicated by arrow 52 in FIG. 7. In this embodiment the first flap 46 constitutes means connecting the first carrier strip 36 to the spine 26 for pivoting between the stated raised and lowered positions. When the post elements 34A, 34B are separated, they may be inserted through openings in pages (not shown) to be inserted in the binder. Thereafter, interengagement of the post elements 34A, 34B secures the pages on the posts 34 so that the pages are held in the binder 20.

Figure 2:
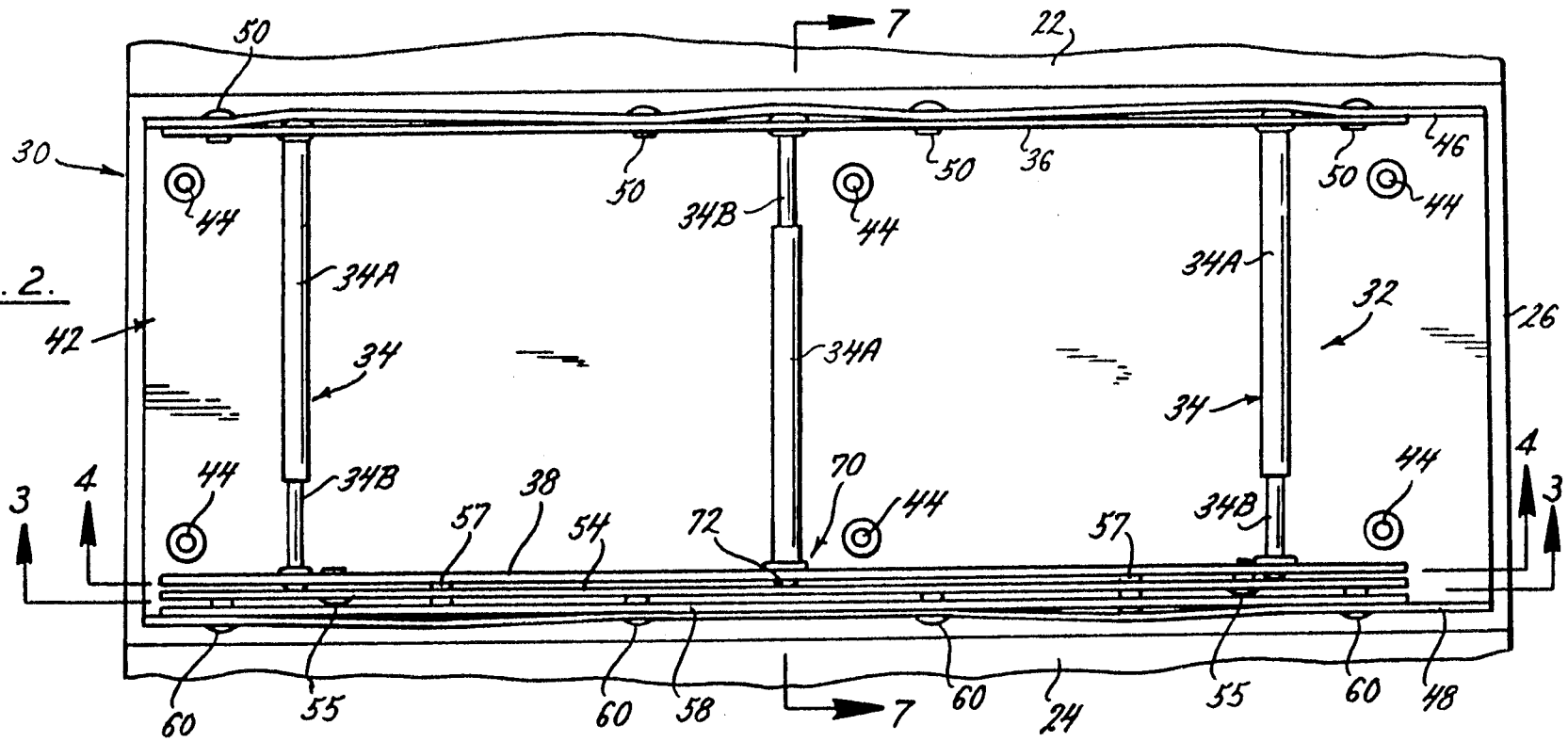
FIG. 2 is a top plan of the page-holding mechanism.

A latching bar 54 (broadly "latching member") is slidably mounted on the second carrier strip 38 of the post assembly 32 by retainer studs 55 received in elongate openings 56 in the latching bar for movement lengthwise of the second carrier strip. When the post assembly is in its aforementioned lowered position, the latching bar 54 can be moved between a latching position (FIG. 3) and a release position (FIG. 8). Referring now to FIGS. 2–4, keeper means on the spine 26 of the binder 20 comprises two keeper pins 57 mounted on a metal strip 58 connected to the second flap 48 of the support plate 42 by suitable fasteners 60. The pins 57 are engageable with the latching bar 54 in its latching position to latch the post assembly 32 in its lowered position in which the post elements 34A, 34B are interengaged and inseparable. In the release position, the latching bar 54 is disengageable from the pins 57 to enable the post assembly 32 to be swung to its raised position. As shown in FIGS. 8 and 9, the pins 57 are simultaneously received in corresponding L-shaped slots 64 (broadly "slot means") in the latching bar 54 and in U-shaped notches 66 in the second carrier strip 38 when the post assembly 32 is swung to its lowered position. The notches 66 open generally downwardly at the lower longitudinal edge of the second carrier strip 38. The slots 64 in the latching bar 54 have a portion 64L which extends generally longitudinally of the latching bar, and a portion 64T which extends transverse to the latching bar and opens at a lower longitudinal edge of the latching bar. When the latching bar 54 is in its release position (FIGS. 8 and 9), the transverse portions 64T of the slots register with the respective notches 66. However, as the latching bar 54 is moved to its latching position, as shown in FIGS. 3 and 6, the pins 57 move into the longitudinally extending portions 64L of the latching bar slots. As illustrated in FIG. 3, in the latching position, the keeper pins 57 are restrained from exiting the slots or the notches 66 by the lower edge of the longitudinal portion 64L of the slot. Thus, the keeper pins 57 prevent separation of the latching bar 54 and second carrier strip 38 from the metal strip 58 and second flap 48, thereby holding the post assembly 32 from swinging from its lowered position to its raised position.

Securing lock means, indicated in its entirety by the numeral 70 (FIG. 7), is provided to prevent the latching bar 54 from being moved from its latching position (FIG. 3) to its release position (FIG. 8) so that the post assembly 32 is locked in its lowered position. When the security lock means 70 is engaged, the page-holding mechanism 30 is secured against pages being removed from or inserted into the binder 20. The security lock means 70 includes a detent 72 mounted on the latching bar 54 which is adapted to spring into engagement with the post assembly 32 when the latching bar is moved to its latching position. As shown in FIG. 7, the post element 34A of the center post 34 extends through the second carrier strip 38 and has an open end facing the latching bar 54. The detent 72 projects into the open end of the center post element 34B, which prevents lengthwise movement of the latching bar 54 relative the second carrier strip 38 to lock the latching bar in its latching position. In the locked latching position, the latching bar 54 is closely adjacent and in face-to-face relation with a face of the second carrier strip 38 facing away from the posts 34 so that the detent is relatively inaccessible and cannot readily be disengaged from the post assembly 32 to permit the latching bar to be moved to its release position.

Figure 10:
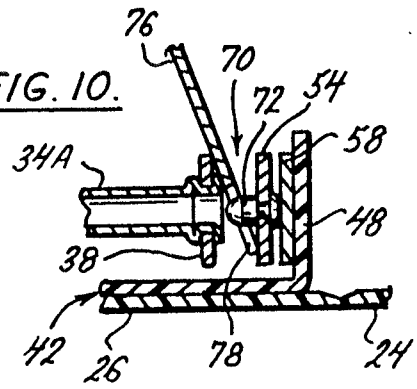
FIG. 10 is a transverse section taken through the center of the post assembly and showing the latching member in its flexed position.
Figure 13:
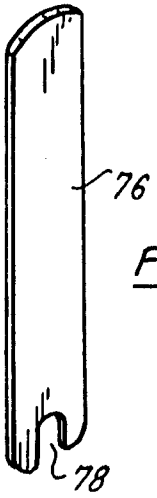
FIG. 13 is a perspective of an implement for use in locking and unlocking the latching member.
Figure 11:
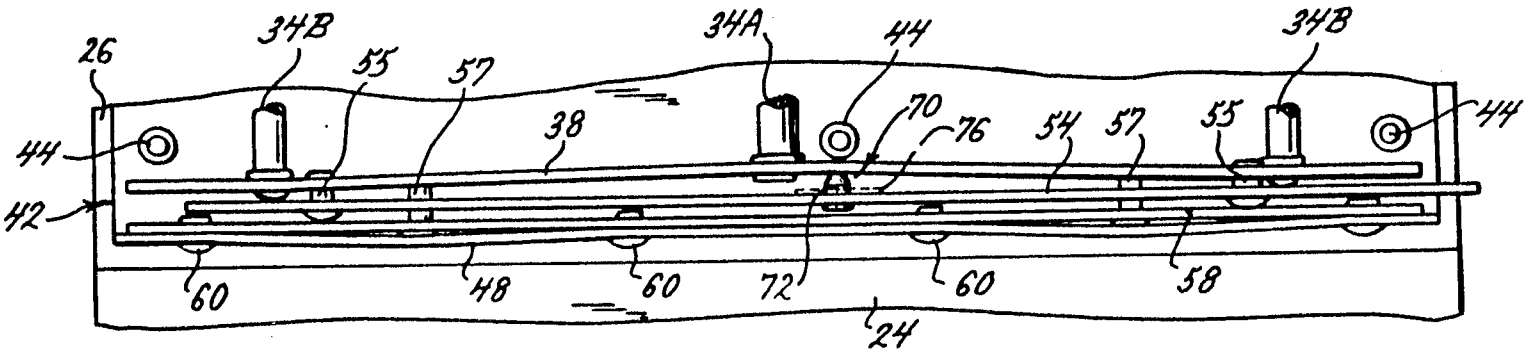
FIG. 11 is a fragmentary top plan of the page-holding mechanism showing the latching member in its flexed position.

The latching bar 54 is made of a resiliently flexible material (a suitable resilient metal) which biases the detent into the opening in the second carrier strip 38 when the latching bar is in its latching position. To release the post assembly 32, such as for adding or taking out pages from the binder 20, the latching bar 54 may be flexed outwardly away from the face of the second carrier strip 38 so that the detent is removed from the opening. In the flexed position, shown in FIG. 11, the latching bar 54 may be moved to its release position (i.e., wherein the laterally extending portion 64L of the slots are aligned with the notches 66). In order to simultaneously flex and move the latching bar 54, an implement 76, shown in FIG. 13, is provided. The rectangular, generally planar implement 76 may be inserted between the latching bar 54 and opposing face of the second carrier strip 38, with a notch 78 being provided in one end of the implement for receiving the detent 72 (FIG. 4). Using the implement 76 in a prying fashion as illustrated in FIG. 10, the latching bar 54 is flexed and the detent 72 withdrawn from the opening in the center post element 34B. As shown in FIGS. 4 and 11, the implement 76 may then be used to move the detent 72, and hence the latching bar 54, lengthwise of the spine 26 and second carrier strip 38 to its release position. Without the implement 76, simultaneously flexing of the latching bar 54 and movement to its release position is very difficult. Therefore, the binder 20 of the present invention is highly resistant to tampering through unauthorized insertion or removal of pages.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A binder with a security lock feature, said binder comprising front and back cover panels connected by a spine, and a page-holding mechanism attached to the spine on the inside of the binder for releasably holding pages in the binder, said page-holding mechanism comprising a post assembly including a plurality of posts extending generally transversely of the spine at locations spaced longitudinally of the spine for holding pages in the binder, each post comprising a pair of interengageable post elements separable to permit pages to be inserted into and removed from the binder, said post assembly being pivotally mounted adjacent the spine of the binder for swinging on an axis extending lengthwise of the spine between a first position in which the post elements of each post are interengaged and inseparable, and a second position in which the post elements are separable, a latching member comprising a latching bar slidably mounted on said post assembly for movement lengthwise of the spine between a latching position for latching said post assembly in said first position and a release position for enabling the post assembly to be moved to said second position, keeper means adjacent the spine of the binder, said latching member being mounted on said post assembly for movement between its said latching position in which it is engageable with said keeper means for latching the post assembly in its said first position, and its said release position in which it is disengageable from said keeper means for enabling the post assembly to be moved to its said second position, security lock means for preventing the latching bar from being moved from its latching position to its release position thereby to lock the post assembly in its first position and thus secure the binder against removal of pages from the binder or insertion of pages into the binder, said security lock means comprising a detent associated with said latching bar, said detent being adapted to spring into engagement with said post assembly when the latching bar is moved to its said latching position thereby automatically to lock said latching bar in said latching position, said detent projecting from a face of the latching bar closely adjacent a face of the post assembly whereby the detent is relatively inaccessible so that the detent cannot readily be disengaged from the post assembly to permit the latching bar to be moved to its release position, said post assembly further comprising a first carrier strip extending lengthwise of the spine generally adjacent one side of the spine and carrying one post element of each post, and a second carrier strip extending generally parallel to the first carrier strip generally adjacent the opposite side of the spine and carrying the other post element of each post, said post elements carried by said first and second carrier strips being interengageable to form posts extending between the carrier strips, and means pivotally connecting the first carrier strip to the spine for pivoting of the post assembly about said axis between said first position in which the second carrier strip is closely adjacent said keeper means and said second position in which the post assembly is swung away from the spine so the post elements may be separated, and said latching bar being mounted on said second carrier strip generally in face-to-face relation with a face of the strip facing away from said posts.

2. A binder as set forth in claim 1 wherein said second carrier strip has an opening therein for receiving said detent when the latching bar is moved to its latching position thereby to lock the latching bar in its said latching position.

3. A binder as set forth in claim 2 wherein said latching bar is mounted on said second carrier strip so that it has a resiliently flexible portion which is adapted to be resiliently flexed away from said second carrier strip, said detent being on said resiliently flexible portion and being biased by the resilience of the latching bar into said opening in the second carrier strip when the latching bar is moved to its latching position, said latching bar being adapted to be resiliently flexed away from the second carrier strip to remove the detent from said opening to enable the latching bar to be moved to its release position.

4. A binder as set forth in claim 3 in combination with an implement adapted for flexing said resiliently flexible portion of the latching bar away from the second carrier strip to remove the detent from said opening, and for moving said latching bar between its said latching and release positions.

5. A binder as set forth in claim 1 wherein said latching bar has slot means therein, said keeper means comprising pin means receivable in said slot means when the latching bar is in its said release position and said post assembly is swung to its said first position, said pin means being movable in said slot means when said latching bar is moved to its latching position to latch the post assembly in its said first position.

6. A binder as set forth in claim 1 wherein said page-holding mechanism further comprises a support plate affixed to the spine, said support plate having opposite side margins bent to form first and second flaps extending lengthwise of the spine, each flap being swingable relative to the spine about an axis extending lengthwise of the spine, said first carrier strip being fastened to said first flap and said keeper means being fastened to said second flap.

* * * * *